US005462149A

United States Patent [19]

Waine et al.

[11] Patent Number: 5,462,149

[45] Date of Patent: Oct. 31, 1995

[54] MONEY VALIDATORS

[75] Inventors: Peter J. Waine, Chobham; Bernard J. Campbell, Sherfield-on-London, both of United Kingdom

[73] Assignee: Mars Incorporated, McLean, Va.

[21] Appl. No.: 70,424

[22] PCT Filed: Dec. 4, 1991

[86] PCT No.: PCT/GB91/02151
Jun. 4, 1993

§ 102(e) Date: Jun. 4, 1993

[87] PCT Pub. No.: WO92/10816

PCT Pub. Date: Jun. 25, 1992

[30] Foreign Application Priority Data

Dec. 7, 1990 [GB] United Kingdom ..... 9026619

[51] Int. Cl.[6] ..... G07D 5/08; G07F 7/04

[52] U.S. Cl. ..... 194/206; 194/317

[58] Field of Search ..... 194/317, 318, 194/319, 206, 207

[56] References Cited

U.S. PATENT DOCUMENTS

| | | | |
|---|---|---|---|
| 4,572,349 | 2/1986 | Furuya et al. | 194/318 |
| 5,167,313 | 12/1992 | Dobbins et al. | 194/317 |

FOREIGN PATENT DOCUMENTS

| | | | |
|---|---|---|---|
| 0101276 | 2/1984 | European Pat. Off. . | |
| 0227453 | 7/1987 | European Pat. Off. . | |
| 0354710 | 2/1990 | European Pat. Off. . | |
| 3513957 | 10/1986 | Germany . | |
| 29205220 | of 1990 | Taiwan . | |
| 85/04037 | 9/1985 | WIPO | 194/317 |

*Primary Examiner*—F. J. Bartuska

*Attorney, Agent, or Firm*—Davis Hoxie Faithfull & Hapgood

[57] ABSTRACT

A coin validator checks the measured properties of a tested item against stored ranges to determine whether the tested item is acceptable. Individual sets of ranges can be enabled and disabled, and switched between narrow and wide ranges, in a teach mode of the validator. Selection of the ranges to be enabled, disabled or switched is accomplished by causing the validator to test an item to determine its type.

46 Claims, 5 Drawing Sheets

FIG. 3.

| | A | B | C | ‖ | R1 | R2 | |
|---|---|---|---|---|---|---|---|
| $P_1$ | $U_{A1}$ | $U_{B1}$ | $U_{C1}$ | ‖ | $U_{R11}$ | $U_{R21}$ | A |
| | $L_{A1}$ | $L_{B1}$ | $L_{C1}$ | ‖ | $L_{R11}$ | $L_{R21}$ | |
| $P_2$ | $U_{A2}$ | $U_{B2}$ | $U_{C2}$ | ‖ | $U_{R12}$ | $U_{R22}$ | |
| | $L_{A2}$ | $L_{B2}$ | $L_{C2}$ | ‖ | $L_{R12}$ | $L_{R22}$ | |
| $P_3$ | $U_{A3}$ | $U_{B3}$ | $U_{C3}$ | ‖ | $U_{R13}$ | $U_{R23}$ | |
| | $L_{A3}$ | $L_{B3}$ | $L_{C3}$ | ‖ | $L_{R13}$ | $L_{R23}$ | |
| F | 1 | 0 | 0 | ‖ | 1 | 0 | |
| $P_1$ | $U'_{A1}$ | $U'_{B1}$ | $U'_{C1}$ | ‖ | $U'_{R11}$ | $U'_{R21}$ | B |
| | $L'_{A1}$ | $L'_{B1}$ | $L'_{C1}$ | ‖ | $L'_{R11}$ | $L'_{R21}$ | |
| $P_2$ | $U'_{A2}$ | $U'_{B2}$ | $U'_{C2}$ | ‖ | $U'_{R12}$ | $U'_{R22}$ | |
| | $L'_{A2}$ | $L'_{B2}$ | $L'_{C2}$ | ‖ | $L'_{R12}$ | $L'_{R22}$ | |
| $P_3$ | $U'_{A3}$ | $U'_{B3}$ | $U'_{C3}$ | ‖ | $U'_{R13}$ | $U'_{R23}$ | |
| | $L'_{A3}$ | $L'_{B3}$ | $L'_{C3}$ | ‖ | $L'_{R13}$ | $L'_{R23}$ | |
| F' | 0 | 0 | 1 | ‖ | 0 | 0 | |

MONEY VALIDATORS

FIELD OF THE INVENTION

This invention relates to money validators, such as coin validators.

BACKGROUND OF THE INVENTION

It is known to provide coin validators which store data defining individual sets of ranges or "windows" the validators being arranged to test items to determine whether they have properties falling within any one of a plurality of sets of windows. If the properties are all found to lie within the windows of a particular set, the validator issues a signal indicating that a valid coin of a particular denomination has been tested.

It is common for such validators to be capable of validating any of a plurality of different denominations of coins. It is often desirable to provide means for preventing the validator from accepting coins of a specific denomination. For this purpose, validators have been provided with individual switches each associated with a respective coin denomination. The switches can be operated to control which denominations are accepted by the validator. The provision of the switches adds to the expense of the validator, occupies valuable space and renders the setting-up of the validator more troublesome in its design. It is also necessary to ensure that the engineer setting-up the validator knows the relationship between the switches and the respective coin denominations.

It is also desirable in some situations to be able to vary the ranges for one or more particular coin denominations. For example, it may be found that genuine coins of a particular denomination tend to get rejected by the validator. To avoid this problem, it may be necessary to widen one or more of the windows in the set associated with that denomination. Alternatively, it may be necessary to narrow one or more of the windows if it is found that counterfeit coins are being erroneously accepted as coins of that denomination. It would be possible to provide further switches to allow for these modifications, but this would further exacerbate the problems mentioned above.

It has been proposed (see British Patent Application No. GB-A-2238152 to store in a validator sets of windows associated with counterfeit coins. If an item is tested and found to have properties lying within the windows of a particular set, then that item is rejected, even if its properties also lie within the windows of a set associated with a genuine coin denomination. These "rejection windows"enable the validator more readily to reject specific types of counterfeit money without significantly preventing acceptance of genuine coins. It would be desirable also to provide a simple means for controlling whether or not the rejection windows are used.

SUMMARY OF THE INVENTION

According to the present invention there is provided a money validator having manually operable switch means enabling the validator to be switched between a testing mode and a teach mode, characterised in that the validator is responsive in the teach mode to measured properties of a tested item so as to select a set of predetermined ranges corresponding to a particular money denomination and to control whether that set is to be effective in the testing mode of the validator, wherein in the testing mode the validator is arranged to validate money by comparing measured properties thereof against the ranges of the set, thereby either to enable or disable acceptance of items of money of that denomination.

Thus, it is necessary only to provide a means for switching to a teach mode, and thereafter money can be inserted into the validator in order to cause the set of ranges associated with that type of money either to be enabled or disabled during the normal testing mode of the validator. Similarly, the ranges associated with a particular denomination can be switched from narrow to wide, or vice versa, simply by inserting the correct money denomination while the validator is in the teach mode. Also, the rejection windows associated with a particular type of counterfeit money can be enabled or disabled by insertion of the counterfeit money during the teach mode.

Accordingly, a validator using a technique of the present invention does not need individual switches associated with respective denominations to enable or disable the respective windows, but instead uses the in-built testing circuitry of the coin to identify the respective denominations.

Although the preferred embodiment uses this technique for both enabling and disabling sets of windows, it would alternatively be possible to provide a validator in which only enabling, or only disabling, is achieved using the technique. The preferred embodiment uses the technique for enabling and disabling both ordinary windows associated with genuine money, and rejection windows associated with counterfeit money. Alternatively, the technique could be used only for genuine money windows, or only for counterfeit money windows.

Preferably, the technique is used both for enabling and disabling windows, and for switching between wide and narrow windows (i.e. disabling one set of windows and enabling instead a different set of windows). If desired, the technique could be used only for switching between wide and narrow windows, or only for completely disabling or enabling the acceptance of selected money denominations.

Preferably, means are provided to enable the user to select whether insertion of money in the teach mode will cause the associated set of windows to be enabled or disabled. In a preferred embodiment, these selection means take the form of a switch conventionally provided on vending machines such as an escrow return switch. It is conventional to provide such a switch so that, after a user has inserted a coin and accumulated credit, he can press the switch to cause his coin to be returned before a vending operation has been carried out. Similar switches are also provided in other coin-operated machines, such as payphones. The arrangement is preferably such that insertion of a coin in the teach mode ensures that the associated set of windows for that coin are enabled, unless the escrow return switch is operated in which case the set of windows is disabled and, preferably, the inserted coin is returned to the user. This provides a particularly convenient method of selection which has the advantage that, because it involves the use of a conventional escrow return switch (which is normally used to return coins to the user) for disabling the window and thus causing future rejection of coins of that denomination and thus return of the coins to the user, its operation is intuitive.

The invention will be described below in the context of coin validators, where it is felt that the techniques of the invention have greatest benefit. However, it would be possible to apply all the techniques described above and below to banknote validators.

Preferably, a validator according to the present invention stores upper and lower limits defining each of a plurality of windows. This however is not essential. For example, the validator could store a single value defining the position of each window, the upper and lower limits being determined either by a separately-stored tolerance value, or by the tolerance of the coin property measurement circuits. Switching between narrow and wide windows can, as described below, be achieved by disabling one set of upper and lower limits and enabling another set, but instead this could be achieved by re-calculating the limits according to a predefined method.

Because the present invention allows the enabling and disabling of ranges to be carried out very easily, it is particularly suitable for in-site adjustment of the validation ranges. Accordingly, the adjustment can be carried out by relatively untrained personnel, such as the machine owners or their staff. This enables rapid and flexible adjustment whenever the circumstances appear appropriate. For example, if the validator is housed in, e.g. a vending machine, and it is found when emptying the cash from the vending machine that one or more counterfeit coins have been erroneously accepted as valid, these same coins can be re-inserted into the validator while the validator is in the teach mode so as to prevent future erroneous acceptance of counterfeit coins having corresponding properties. This aspect is considered to be independently inventive. For example, the measured properties of the counterfeit item may fall within rejection windows which are enabled in the teach mode. Alternatively, the teach mode could respond to the counterfeit item by switching from relatively wide windows associated with a genuine coin denomination to relatively narrow windows.

It is to be noted that GB 1452740 and EP-A-0155126, for example, disclose coin validators which respond to inserted coins by calculating the windows to be used to test the coins. GB 1452740 discloses a "learn mode", in which the windows are calculated by taking measurements of inserted coins. EP-A-0155126 discloses continuous re-calculation of windows based on the measured properties of coins which have been inserted and found to be valid. In both of those cases, however, the measured properties are used to define the windows, whereas the present invention is concerned with the selection of predefined windows.

BRIEF DESCRIPTION OF THE DRAWINGS

An arrangement embodying the invention will now be described by way of example with reference to the accompanying drawings, in which:

FIG. 3 schematically illustrates the part of a memory of the validator which stores limit values defining windows;

DETAILED DESCRIPTION OF THE INVENTION

Figure 1:
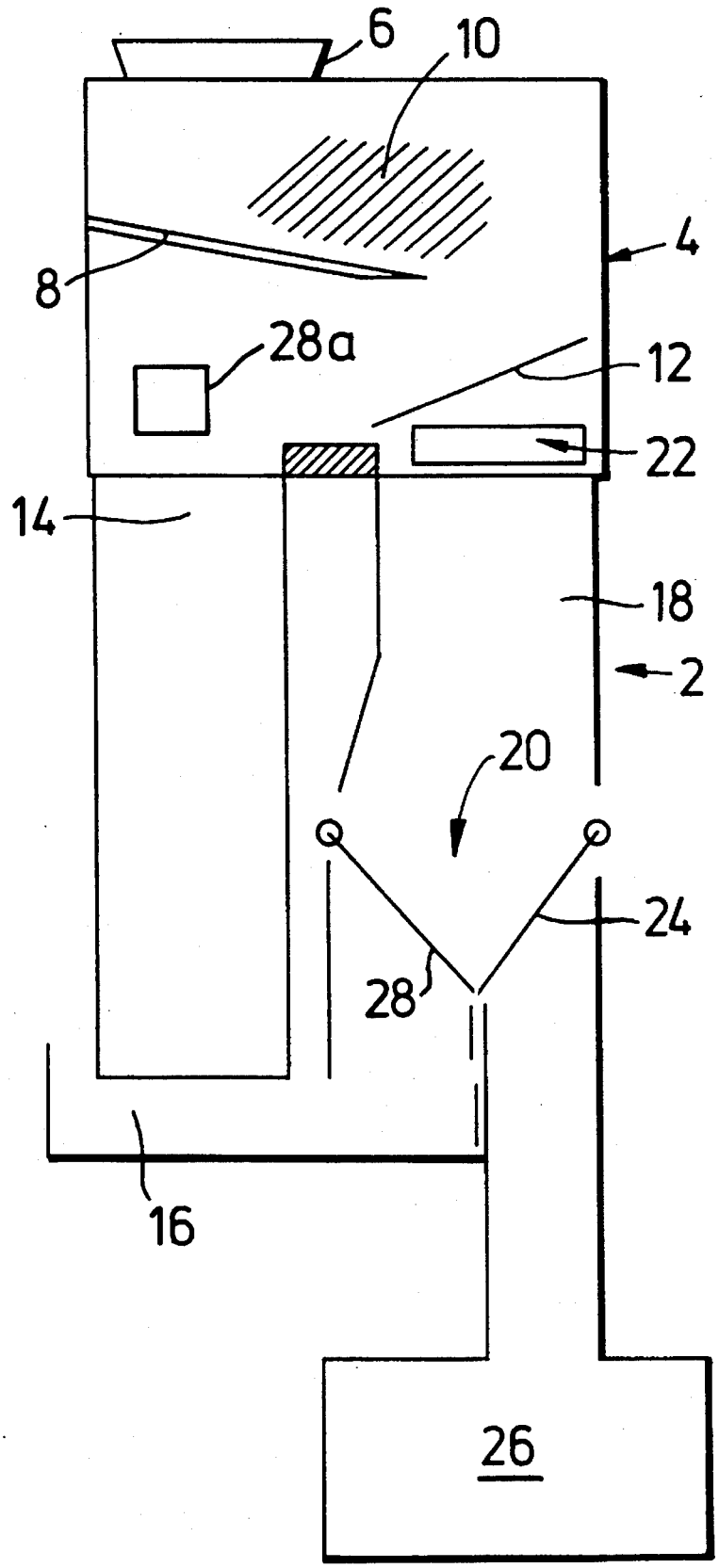
FIG. 1 is a schematic view of a coin mechanism including a coin validator in accordance with the invention.

Referring to FIG. 1, a coin mechanism 2 has a validator 4 which comprises a hopper 6 into which coins can be inserted. The coins fall on to a ramp 8 and then roll down the ramp past a testing region indicated by the shaded section 10. The coins then fall towards an accept gate shown schematically at 12. If the coins have been tested and found not to be genuine, the coins are diverted by the accept gate 12 into a reject path 14, which delivers the coins to a refund tray 16.

If the coins are acceptable, a solenoid is energised to cause the accept gate 12 to shift into a position in which it opens an accept path 18 leading to an escrow bucket 20. Coins entering the accept path 18 move past a sensing arrangement shown generally at 22. After the sensing arrangement 22 has detected that a coin has moved past, it triggers the accumulation of credit, thus permitting a user to operate a machine (not shown) in which the validator is housed. After the machine has provided goods or a service to the value of the accumulated credit, an escrow accept gate 24 is opened to allow a coin or coins held thereby to fall into a cash box 26. Before provision of the goods or services, the user can alternatively press an escrow return button 28*a*, on the exterior of the coin mechanism, to cause an escrow return gate 28 to open and so allow coins in the escrow bucket 20 to travel to the refund tray 16.

Arrangements generally of this type are well known, although the physical structure of such arrangements varies substantially.

Figure 2:
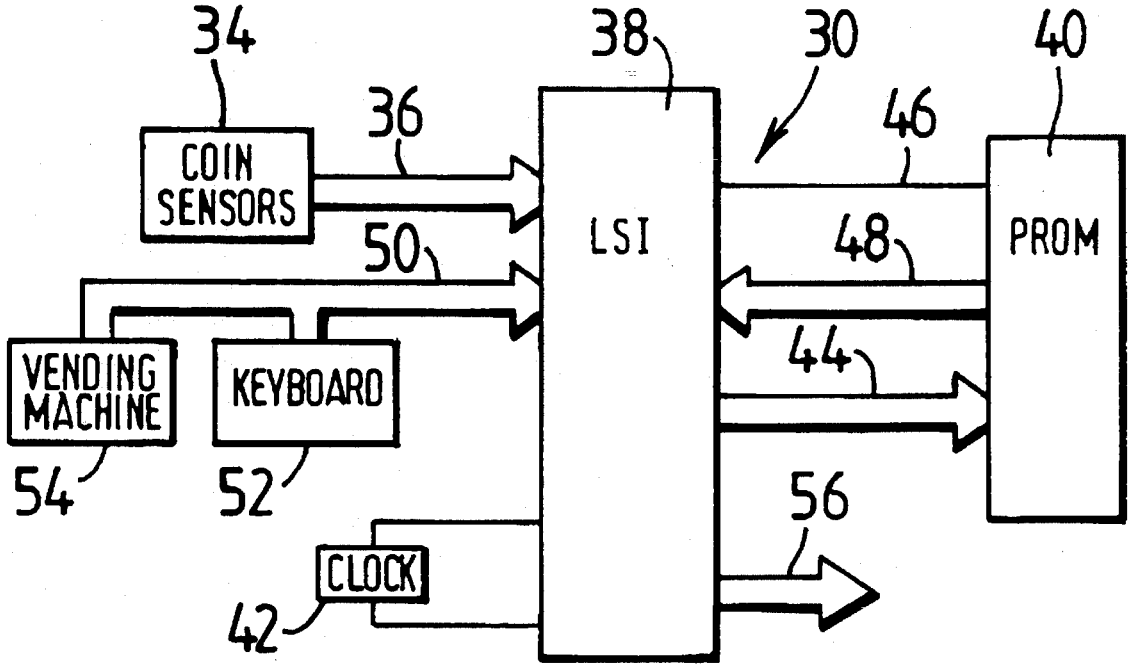
FIG. 2 is a schematic block diagram of the circuitry of the validator.

The circuitry 30 of the coin testing apparatus shown schematically in FIG. 2 includes a set of coin sensors indicated at 34 forming the testing section 10. Each of these sensors is operable to measure a different property of a coin inserted in the apparatus, in a manner which is in itself well known. Each sensor provides a signal indicating the measured value of the respective parameter on one of a set of output lines indicated at 36.

An LSI 38 receives these signals. The LSI 38 contains a read-only memory storing an operating program which controls the way in which the apparatus operates. Instead of an LSI, a standard microprocessor may be used. The LSI is operable to compare each measured value received on a respective one of the input lines 36 with upper and lower limit values stored in predetermined locations in a PROM 40. The PROM 40 could be any other type of memory circuit, and could be formed of a single or several integrated circuits, or may be combined with the LSI 38 (or microprocessor) into a single integrated circuit.

The LSI 38, which operates in response to timing signals produced by a clock 42, is operable to address the PROM 40 by supplying address signals on an address bus 44. The LSI also provides a "PROM-enable" signal on line 46 to enable the PROM. In response to the addressing operation, a limit value is delivered from the PROM 40 to the LSI 38 via a data bus 48.

The LSI 38 also has input lines 50 for receiving signals from a keyboard 52 housed in the host vending machine and accessible only to an operator who has a key to unlock the machine, and for receiving signals from other parts of the vending machine indicated generally at 54, including the escrow return button. Instead of a keyboard, simple switches (e.g. Dual-In-Line switches) could be used. Alternatively, the LSI could be controlled by signals received from other equipment to which the validator is connected.

By way of example, one embodiment of the invention may comprise three sensors, for respectively measuring the conductivity, thickness and diameter of inserted coins. On insertion of a coin, the measurements produced by the three sensors 34 are compared by the LSI 38 with selected values stored in the region of the PROM 40 shown in FIG. 3. Considering first the part of the PROM indicated at A, the LSI 38 is capable of comparing the thickness measurement with the values representing the limits of ranges for respective coins A, B, C, . . . etc., in the rows marked $P_1$. If the measured thickness value lies within the upper and lower limits of the thickness range for a particular coin (e.g. if it lies between the upper and lower limits $U_{A1}$ and $L_{A1}$ for the coin A), then the thickness test for that coin has been passed. Similarly, the diameter measurement can be compared with the upper and lower limit values in the rows $P_2$, and the conductivity measurement is compared with the limit values in the rows marked $P_3$.

If and only if all the measured values fall within a set of three stored ranges for a particular coin denomination which the apparatus is designed to accept, the LSI 38 produces an ACCEPT signal on one of a group of output lines 56, and a further signal on another of the output lines 56 to indicate the denomination of the coin being tested. The accept gate 12 adopts one of two different states depending upon whether the ACCEPT signal is generated, so that all tested coins deemed genuine are directed along the accept path 18 and all other tested items along the reject path 14.

Preferably, the PROM 40 is also operable to store additional sets of ranges R1 and R2, each set being associated with a respective type of counterfeit money. The validator can be arranged such that, if the measured properties are found to lie within the ranges associated with one of these sets, e.g. R1, the validator will not issue an accept signal even if the properties also lie within the ranges associated with one of the valid coins A, B, C, etc.

The LSI 38 selects the respective sets of ranges associated with the coins A, B, C, . . . and counterfeit money R1, R2 in accordance with the states of respective flags F. Thus, the ranges associated with coin A which are stored in the part A of the PROM will be used by the LSI because the respective flag F is set to "1". Similarly, the LSI 38 will compare the measurements with the ranges for counterfeit money R1, because the respective flag F is set to "1". However, the LSI will disregard the ranges associated with coins B, C and counterfeit money R2, because the respective flags F are set to "0".

The PROM 40 also stores in section B alternative ranges for the respective coins A, B, C, etc. and counterfeit money R1, R2. At least some of these ranges are narrower than the corresponding ranges stored in section A of the PROM. Thus, for example, the range $U'_{A1}$ to $L'_{A1}$ stored in section B is narrower than the corresponding range $U_{A1}$ to $L_{A1}$ in section A. Section B also stores respective flags F' for the coin denominations A, B, C, etc. and counterfeit money R1, R2, so that the narrower sets of ranges can be selectively enabled and disabled. In the example shown in FIG. 3, the wide range for coin A is enabled (F= 1) and the narrow range is disabled ($F^1$=0). Both ranges for denomination B are disabled, so that all coins of denomination B will be rejected by the validator. The narrow range for denomination C is enabled (F'=1) and the wide range disabled (F= 0). Similarly, only the wide range for counterfeit money R1 is enabled, and neither of the ranges for counterfeit money R2 are enabled. The LSI 38 can selectively change the flags F and F' in the manner set out below so as selectively to enable and disable the respective sets of ranges.

Figure 4:
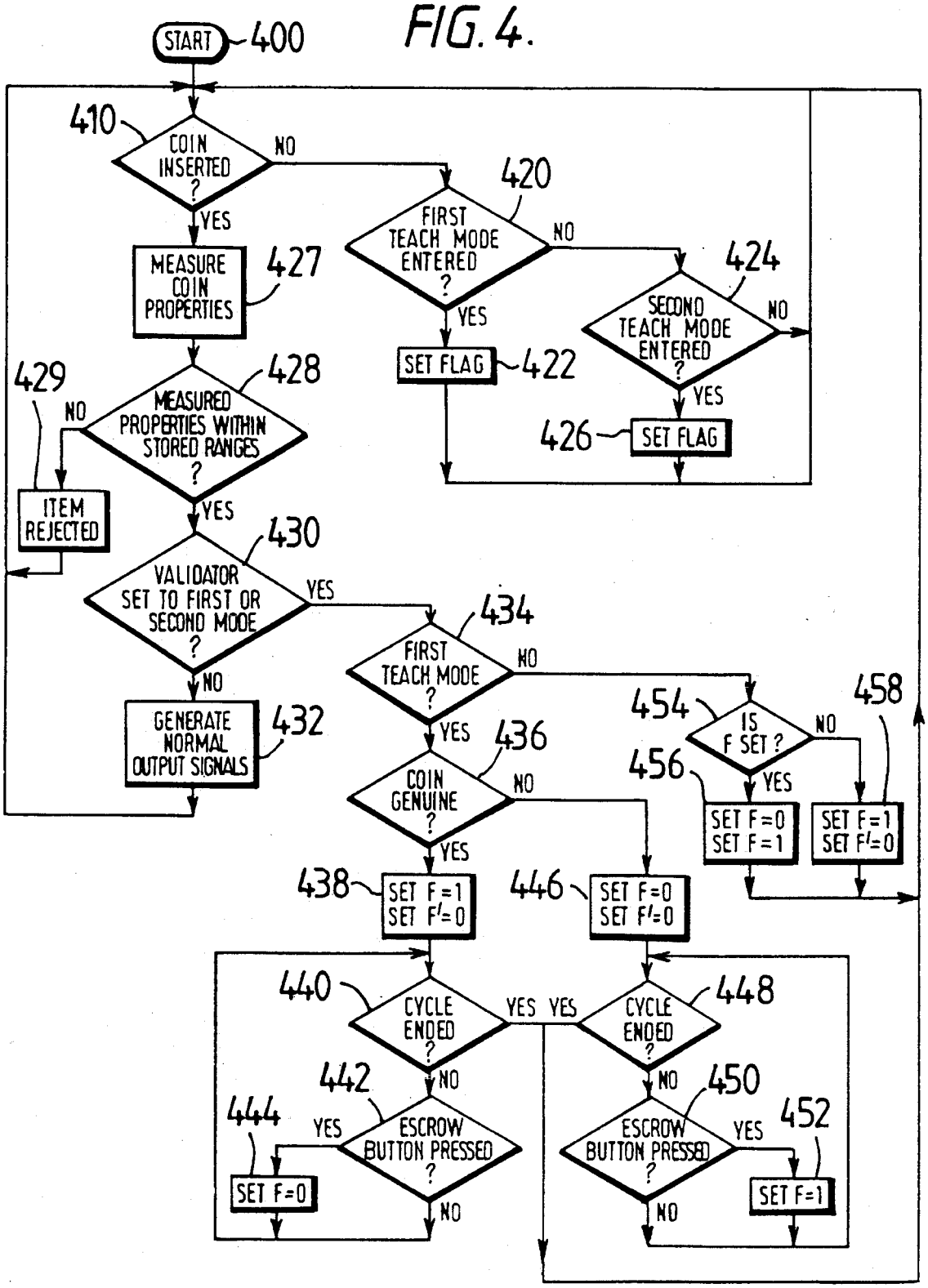
FIG. 4 is a flowchart illustrating the operation of the validator.

FIG. 4 shows an example of how the validator may be arranged to operate, the figure relating only to those parts of the operation which are relevant to the present invention. The operation starts at step 400, and then following an initialization operation proceeds to step 410 where the validator checks to determine whether a coin has been inserted. If not, the program proceeds to step 420 to determine whether the keyboard 52 has been operated in such a manner as to instruct the machine to enter a first teach mode. For example, the machine may check to determine whether the operator has pressed a specific key or key sequence associated with this mode. If so, the program proceeds to step 422 to set a flag indicating that the first teach mode has been entered. Otherwise, the program proceeds to step 424 to check whether the keyboard has been operated to put the validator into a second teach mode. If so, an appropriate flag is set at step 426. In any event, the program loops back to step 410, so that the validator again checks to determine whether a coin has been inserted.

The program proceeds in this fashion until a coin is inserted, and then proceeds to step 427. At this step the coin properties are measured and compared against the ranges stored in the PROM 40. If the machine is in either the first teach mode or the second teach mode, the LSI 38 compares the stored measurements with all the ranges stored in the PROM 40. The LSI may be arranged to check each set of ranges in sequence, preferably starting with the rejection windows. It may be arranged so that the sets are checked until the measurements are found to fall within the respective ranges, following which the remaining sets are disregarded. Alternatively, the LSI may be arranged always to check all the ranges. As a further alternative, the LSI may take the property measurements in turn, each time checking the measurement against the relevant ranges in the respective sets.

If the machine is in neither teach mode, the LSI uses only those ranges for which the respective flag F or F' has been set. The LSI preferably just disregards other ranges, but if desired the measurements can be checked against all the sets of ranges, and any resulting accept signal can be inhibited if the measurements lie within a set of ranges with an associated flag setting of "0".

The result of step 427 is that the LSI determines the denomination of the inserted coin, if it is genuine, or the type of counterfeit money which is being inserted. If the measured properties did not fall within any of the stored sets of ranges, this is determined by the LSI 38 at step 428, and the program proceeds to step 429, where the inserted item is rejected, and then loops back to step 410.

Otherwise, at step 430 the program checks whether the validator has been set to the first or second teach mode. If not, the program proceeds to step 432 where the normal output signals are generated to indicate whether an acceptable coin has been received, and if so the denomination of the coin. The program then loops back to step 410.

If at step 430 it determines that one of the teach modes has been entered, the program proceeds to step 434, which checks to determine whether the validator is in the first teach mode. If so, the program proceeds straight to step 436, in which the results of the test carried out in step 428 are checked to determine whether the coin was a genuine coin of type A, B, C, etc., or a counterfeit coin of type R1, R2.

If the coin was found to be genuine, the program proceeds to step 438. Here, the respective flag F associated with the denomination of the inserted coin is set to "1" irrespective of its current value The flag F' for the corresponding set of narrow ranges is cleared to "0".

At step 440, the program checks to determine whether the current validation cycle has ended. The end of the cycle can be defined by various events, e.g. the insertion of a further coin, the elapsing of a particular delay time, etc. If the cycle has not ended, the program proceeds to step 442, to determine whether the escrow return button has been pressed. If not, the program loops back to step 440. If the escrow return button is pressed during the current validation cycle, the program proceeds to step 444 where the respective flag F associated with the denomination of the inserted coin is cleared to "0". At the end of the validation cycle, the program loops back from step 440 to step 410.

Accordingly, by operating the keyboard so as to set the validator into the first teach mode, and then inserting a coin of, e.g., denomination B, the wide ranges stored in section A of the PROM for coin B are enabled. If, however, the operator presses the escrow return button after inserting the coin of denomination B, the ranges are disabled, and the coin is returned to the user via refund tray 16.

At step 436, the program may determine that the inserted coin is counterfeit, of type R1 or R2. Such a counterfeit coin may have previously been accepted by the validator and delivered to the store 26. The counterfeit coin could then be retrieved from the store and re-inserted into the validator during the teach mode so as to prevent future erroneous acceptance of such counterfeits. If the inserted coin is counterfeit, the program proceeds to steps 446, 448, 450 and 452. These respectively correspond to steps 438, 440, 442 and 444, except that at step 446 the flag F for the respective range is cleared to "0", and at step 452 the flag F is set to "1". This is because it is intuitively more correct for the ranges associated with a counterfeit coin to be enabled (so that items having similar properties are rejected and returned to the user) in response to the pressing of the escrow return button which causes the inserted item to be refunded. However, if desired, the operation for counterfeit coins can be the same as the operation for genuine coins.

If, at step 434, it is found that the validator has entered the second teach mode, the program proceeds to step 454. Here, the program checks to determine whether the flag F associated with the inserted coin is set. If so, the program proceeds to step 456, where the flag F is cleared to "0" and the corresponding flag F' is set to "1". The program then loops back to step 410.

Otherwise, the program proceeds from step 454 to step 458, where the flag F is set to "1", and the flag F' is cleared to "0".

In this way, the operator can switch between the narrow and wide ranges for a particular coin by setting the machine in the second teach mode, and then inserting a coin of the correct type. If desired, the machine may have a display to indicate whether the currently-set range is narrow or wide.

In the above embodiment, in each of the teach modes the LSI determines at step 428 the type of the inserted coin by checking the properties against the stored ranges in parts A and B of the PROM 30. The item is determined to be of a particular type if its measured properties fall within either the wide ranges stored in part A or the narrow ranges stored in part B. If greater reliability is required, the machine can be arranged so that in the test modes the inserted item is only designated as a specific type if its property measurements fall within the narrow ranges of part B. As a further alternative, the validator can use a completely separate set of windows for the teach modes, which are preferably even narrower than those stored in part B of the PROM 30.

In the operations described above, the measured properties of the tested item fell within the ranges which are enabled or disabled. This however is not essential. As an example of an alternative technique, the machine can be arranged so that in the teach mode it detects when an inserted item has properties which resemble but do not exactly match those of a genuine coin. For example it may detect when one of the properties lies outside but close to one of the ranges for a genuine coin. The other properties might lie within or close to the other respective ranges. In response to detecting this situation, the machine could be arranged to render the ranges associated with the genuine coin ineffective, and preferably cause a different set (wherein at least one of the ranges is narrower) to be enabled. Determining that a non-genuine item has properties resembling but not exactly matching those of a genuine coin indicates a substantial risk that other, similar non-genuine coins might be erroneously accepted by the validator. However, by adjusting the ranges in the manner set out above, this problem is avoided.

Instead of storing separate sets of ranges in parts A and B of PROM 30, a single set may be stored for each coin type. The LSI can be arranged to recalculate the ranges at steps 456 and 458 so as to increase or decrease the widths of one or more of the ranges in a predetermined manner.

It is not necessary for all, or indeed any, coin types to have ranges which are selectable between wide and narrow.

It will be appreciated that the first and second teach modes referred to above collectively form an operational mode permitting selective enabling and disabling of predefined windows which are selected according to the results of testing an inserted item.

The term "coin" is intended herein to mean genuine coins, tokens, counterfeit coins, slugs, washers and any other such item.

Figure 5:
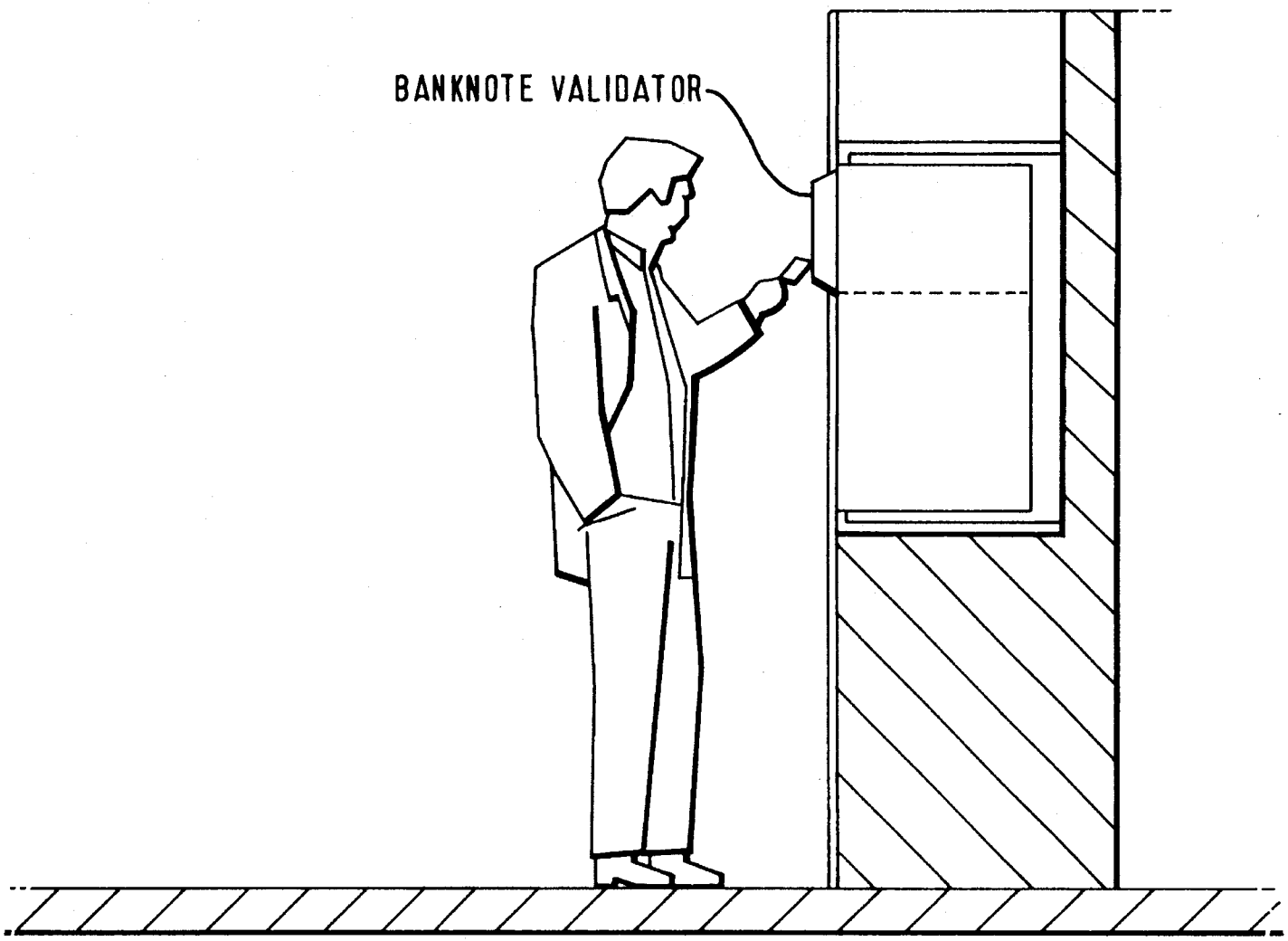
FIG. 5 is a view of the validator of the present invention, including a banknote validator.

As discussed above, the present invention is applicable to banknote validators, as well. FIG. 5 is an external view of a banknote validator 60, incorporating the teachings of the present invention.

We claim:

1. A method of adjusting a money validator which is operable in a testing mode to compare measured properties of an item with a set of ranges to determine whether the item is genuine money, the validator being arranged to deliver items which have been tested and found genuine to a store, wherein the method comprises selecting from the store a non-genuine item which has erroneously been found by the validator to be genuine, and causing the validator to test the non-genuine item while the validator is in a teach mode, the validator being responsive to the measured-properties of the item for enabling or disabling at least one set of ranges in such a manner as to prevent future erroneous determination that items with such properties are genuine.

2. A method of selecting the particular monetary types which can be accepted by a coin validator out of a plurality of monetary types which can be accepted by the validator, comprising:

enabling a teach mode wherein the validator is responsive to at least one measured value of a test item inserted into the validator;

measuring at least one value of the inserted test item;

selecting acceptance criteria corresponding to the type of the inserted test item in response to the measured value of the inserted test item; and enabling the acceptance criteria corresponding to the type of the inserted test item such that test items of that type can be accepted by the validator.

3. The method of claim 2, further comprising comparing the measured value of the inserted test item to a plurality of acceptance criteria corresponding to the plurality of monetary types to select the acceptance criteria which corresponds to the type of the inserted test item.

4. The method of claim 2, further comprising disabling the acceptance criteria corresponding to another test item of another type inserted into the validator such that test items of that type cannot be accepted.

5. The method of claim 3, further comprising disabling the acceptance criteria corresponding to another test item of another type inserted into the validator such that test items of that type cannot be accepted.

6. The method of claim 2, further comprising enabling one of at least two different acceptance criteria for the same monetary type.

7. The method of claim 4, further comprising manually activating a switch to enable or disable acceptance criteria.

8. The method of claim 5, further comprising manually activating a coin return switch to enable or disable acceptance criteria.

9. The method of claim 2, wherein the monetary type includes counterfeits.

10. The method of claim 9, further comprising:

selecting rejection criteria corresponding to the type of the inserted test item based on the measured value of the inserted test item, and enabling the rejection criteria corresponding to the type of inserted test item such that test items of that type will be rejected by the validator.

11. The method of claim 9, further comprising manually activating a coin return switch to enable rejection criteria.

12. A money validator comprising:

means for measuring a plurality of properties of a tested item;

means for storing data defining predetermined ranges of acceptable measured properties for each monetary type which can be accepted by the validator;

manually operable switch means enabling the validator to be switched between a testing mode and a teach mode;

means for selecting in the teach mode the predetermined ranges corresponding to a particular monetary type based on the measured properties; and means for comparing in the testing mode the measured properties to the ranges selected in the teach mode.

13. A money validator as claimed in claim 12, wherein the means for comparing is operable in the teach mode to compare the measured properties of a tested item against the ranges of a plurality of sets, and the means for selecting selects a set with ranges within which all the measured properties fall.

14. A money validator as claimed in claim 12, including user-operable switch means for selecting whether a selected set of ranges is enabled or disabled so as respectively to permit and prevent the set being effective for validating money in the testing mode.

15. A money validator as claimed in claim 14, wherein the switch means comprises an escrow return button, which is used to cause money which has been delivered to the validator to be returned to the user.

16. A money validator as claimed in claim 12, wherein the plurality of monetary types includes types of counterfeit coins.

17. A money validator as claimed in claim 16, wherein the means for storing further stores predetermined rejection ranges corresponding to counterfeit coins and the means for selecting is operable in the teach mode to select a rejection set of ranges which, when effective in the testing mode, causes the validator to prevent the production of a signal indicating that a test item is a genuine coin upon determining that the measured properties of the item fall within said set of ranges.

18. A money validator as claimed in claim 12, wherein the means for storing stores two alternative sets of ranges both associated with the same coin type and the means for selecting is operable in the testing mode to select either one of the two alternative sets of ranges, wherein at least one of the ranges in one of the alternative sets differs from the corresponding range in the other alternative set.

19. The money validator of claim 12, wherein the money validator is a coin validator.

20. The money validator of claim 12, wherein the money validator is a banknote validator.

21. A money validator comprising:

at least one sensor for examining a test item inserted into the validator, the sensor producing an output due to examination of the test item;

memory means storing a plurality of predetermined acceptance criteria corresponding to a plurality of monetary types, and state data indicating whether each of said acceptance criteria is in an enabled state or a disabled state;

a control circuit operatively connected to the output of the test item sensor and the memory means, the control circuit having a first mode and a second mode, wherein, in the first mode, the control circuit determines the acceptability of the test item based on the output of the sensor and the acceptance criteria indicated by the state data to be in an enabled state and, in the second mode, the control circuit selects particular acceptance criteria based on the output of the test item and in response thereto changes the associated state data; and a manual switch operatively connected to the control circuit for enabling the first mode or the second mode.

22. The money validator of claim 21, wherein the control circuit is operable in the second mode to compare the output of the sensor to the plurality of predetermined acceptance criteria, and to select particular acceptance criteria which corresponds to the output of the sensor.

23. The money validator of claim 21, wherein the control circuit is operable to enable the selected acceptance criteria, so that the selected acceptance criteria is effective for validating money in the first mode.

24. The money validator of claim 21, wherein the control circuit is operable to disable the selected acceptance criteria, so that the selected acceptance criteria is not effective for validating money in the first mode.

25. The money validator of claim 21, wherein the control circuit is operable selectively to enable and disable selected acceptance criteria, so as respectively to permit and prevent the selected acceptance criteria being effective for validating money in the first mode.

26. The money validator of claim 25, including user-operable switch means for selecting whether the selected acceptance criteria is enabled or disabled.

27. The money validator of claim 26, wherein the switch means comprises an escrow return button, which is used to cause money which has been delivered to the validator to be returned to the user.

28. The money validator of claim 21, wherein the control circuit is operable in the second mode to select particular acceptance criteria which, when effective in the first mode, causes the validator to provide a signal indicating that a tested item is genuine money upon determining that the sensor output due to examination of the item falls within the particular acceptance criteria.

29. The money validator of claim 21, wherein the plurality of monetary types include types of counterfeit money.

30. The money validator of claim 29, wherein the control circuit is operable in the second mode to select particular acceptance criteria which, when effective in the first mode, causes the validator to prevent production of a signal indicating that a tested item is genuine money upon determining that the sensor output due to examination of the item falls within the particular acceptance criteria.

31. The money validator of claim 21, wherein the control circuit is operable in the second mode to select either one of two alternative acceptance criteria both associated with the same monetary type.

32. The money validator of claim 31, wherein the memory means stores respective sets of data each defining a respective one of said alternative acceptance criteria.

33. The money validator of claim 32 wherein the control circuit is operable to perform a calculation to derive at least one of said alternative acceptance criteria.

34. The money validator of claim 21, wherein the control circuit, in the second mode, is arranged to change the associated state data from indicating an enabled state to indicating a disabled state.

35. The money validator of claim 21, wherein the control circuit, in the second mode, is arranged to change the associated state data from indicating an disabled state to indicating an enabled state.

36. The money validator of claim 21, wherein the manual switch is part of a keyboard.

37. A money validator capable of accepting a plurality of monetary types comprising:

at least one sensor for examining a test item inserted into the validator, the sensor producing an output due to examination of the test item;

a memory storing data defining a plurality of predetermined acceptance criteria for the monetary types which can be accepted by the validator;

a control circuit operatively connected to the output of the test item sensor and the memory, the control circuit having a first and second mode wherein in the first mode, the control circuit enables particular acceptance criteria based on the output of the sensor due to examination of the test item so that the particular acceptance criteria is effective for validating money, and in the second mode, the control circuit determines the acceptability of the test item based on the output of the sensor and the acceptance criteria enabled when the validator was in the first mode; and a manual switch operatively connected to the control circuit for enabling the first or second mode.

38. The money validator of claim 37, wherein the memory further stores rejection criteria and the validator can be set in the first mode to select rejection criteria corresponding to the test item such that, in the testing mode, the selected rejection criteria can be used to determine if the test item should be rejected.

39. The money validator of claim 37, wherein the switch is an escrow return button.

40. The money validator of claim 37, wherein alternative acceptance criteria for a monetary type can be derived, at least in part, by the control circuit by a calculation.

41. The money validator of claim 37, wherein the memory stores mean values of a plurality of ranges of measured properties corresponding to the plurality of predetermined acceptance criteria.

42. A money validator capable of accepting a plurality of monetary types comprising:

at least one sensor for examining a test item inserted into the validator, the sensor producing an output due to examination of the test item;

a memory storing data defining a plurality of predetermined acceptance criteria for the monetary types which can be accepted by the validator;

a control circuit operatively connected to the output of the test item sensor and the memory, the control circuit having a first and second mode wherein in the first mode, the control circuit disables particular acceptance criteria based on the output of the sensor due to examination of the test item so that the particular acceptance criteria is not effective for validating money, and in the second mode, the control circuit determines the acceptability of the test item based on the output of the sensor and the acceptance criteria not disabled when the validator was in the first mode; and a manual switch operatively connected to the control circuit for enabling the first or second mode.

43. The monetary validator of claim 42, wherein the memory further stores rejection criteria and the validator can be set in the first mode to select rejection criteria corresponding to the test item such that, in the testing mode, the selected rejection criteria can be used to determine if the test item should be rejected.

44. The money validator of claim 42, wherein the switch is an escrow return button.

45. The money validator of claim 42, wherein alternative acceptance criteria for a monetary type can be derived, at least in part, by the control circuit by a calculation.

46. The money validator of claim 42, wherein the memory stores mean values of a plurality of ranges of measured properties corresponding to the plurality of predetermined acceptance criteria.

* * * * *